United States Patent [19]

Schanwald

[11] Patent Number: 4,614,339

[45] Date of Patent: Sep. 30, 1986

[54] BATTING PRACTICE BASEBALL AND METHOD

[76] Inventor: Stephen M. Schanwald, 1130 N. Dearborn, Apt. 2803, Chicago, Ill. 60610

[21] Appl. No.: 600,505

[22] Filed: Apr. 16, 1984

[51] Int. Cl.[4] ..... A63B 69/00; A63B 37/00

[52] U.S. Cl. ..... 273/26 R; 273/60 R; 273/DIG. 20

[58] Field of Search ..... 273/60 R, 60 B, 34 B, 273/DIG. 20, 26 R, 58 R, 58 A, 60 A

[56] References Cited

U.S. PATENT DOCUMENTS

| | | | |
|---|---|---|---|
| 2,278,649 | 4/1942 | Dickson et al. | 273/60 R |
| 4,201,384 | 5/1980 | Barber | 273/DIG. 20 X |
| 4,211,407 | 7/1980 | Tomar | 273/60 B |
| 4,286,783 | 9/1981 | Newcomb et al. | 273/60 B X |

FOREIGN PATENT DOCUMENTS

| | | | |
|---|---|---|---|
| 220377 | 8/1924 | United Kingdom | 273/34 B |

OTHER PUBLICATIONS

"American Weekly", Washington, D.C., May 14, 1939.

"Worth" Catalogue, Lannom Mfg. Co., Inc., Tullahoma, Tennessee, 1976.

*Primary Examiner*—George J. Marlo

*Attorney, Agent, or Firm*—Mason, Kolehmainen, Rathburn & Wyss

[57] ABSTRACT

A batting practice baseball has a circumference and a diameter in the range of from approximately 65% to approximately 90% of the circumference and diameter of a regular or official league baseball sanctioned for use in league games by Rule 1.09 of the Official Baseball Rules. Preferably, the circumference of the batting practice baseball is in the range of from 5.85 inches to 8.33 inches, and the outer diameter is in the range of from 1.86 inches to 2.65 inches. The weight of the batting practice baseball is the same as the weight of an official baseball; and the resilience of the batting practice baseball should be the same as or equivalent to the resilience of an official baseball. This is achieved by constructing the batting practice baseball with materials and with yarn tension sufficient to provide a coefficient of restitution in the range of from approximately 51.4% to approximately 57.8%. Use of the comparatively smaller batting practice baseball during batting practice should improve the batting skills of a player and make the task of hitting the comparatively larger official baseball in a game situation much easier.

10 Claims, 3 Drawing Figures

BATTING PRACTICE BASEBALL AND METHOD

BACKGROUND OF THE INVENTION

A. Field of the Invention

The device of the present invention generally relates to organized sports activities and, more particularly, to a new and improved method and ball for use in baseball batting practice.

B. Description of the Prior Art

The sport of baseball has been played on an organized basis since the nineteenth century. The ball used in this sport has been generally of the same configuration for many years. Rule 1.09 of the Official Baseball Rules governing amateur and professional league play in the United States of America provides that the ball shall be a sphere formed by yarn wound around a small core of cork, rubber or similar material, covered with two stripes of white horsehide or cowhide tightly stitched together. Rule 1.09 further provides that the ball shall weigh not less than five nor more than five and one-quarter ounces avoirdupois and measure not less than nine nor more than nine and one-quarter inches in circumference. Due to the speed with which a baseball can be thrown by a talented pitcher and due to the 216 red outer cotton stitches that hold the baseball's two-piece leather cover together and that create an uneven flow of air over the baseball's surface after being thrown by a pitcher, the task of a player to successfully hit the baseball is formidable. Thus, it is customary in organized league play for baseball players to spend time in batting practice. Such practice hopefully will improve a player's ability visually to follow the flight of the baseball and the player's timing in swinging a baseball bat into engagement with the baseball to achieve a solid impact or hit between the bat and the baseball. The baseball used during batting practice traditionally has been the baseball specified by the Official Baseball Rules, that is, one identical to the official baseball used in league play. While batting practice is effective in honing a player's batting skills, new methods and devices are constantly being sought to further refine batting skills.

SUMMARY OF THE INVENTION

An object of the present invention is to provide a new and improved baseball for use in batting practice.

Another object of the present invention is to provide a new and improved method of conducting baseball batting practice.

Another object of the present invention is to provide a new and improved baseball for use in batting practice and a new and improved method for conducting batting practice utilizing such a baseball in which the baseball is substantially dimensionally smaller than the baseball used in game situations.

Briefly, the present invention relates to a new and improved batting practice baseball and a new and impoved method for conducting baseball batting practice. The batting practice baseball is dimensionally smaller than the regular or official baseball sanctioned by Rule 1.09 of the Official Baseball Rules for use in league games. Specifically, the circumference and diameter of the inventive batting practice baseball are in the range of from approximately 65% to approximately 90% of the circumference and diameter of the regular or official league baseball sanctioned by the Official Baseball Rules. Since Rule 1.09 provides that the baseball shall be not less than nine nor more than nine and one-quarter inches in circumference, the circumference of the inventive batting practice baseball is in the range of from approximately 5.85 inches to approximately 8.33 inches. Preferably, the circumference of the inventive batting practice baseball is approximately seven inches which is approximately 77% of the circumference of an official baseball sanctioned for use in league games.

The weight of the inventive batting practice baseball is the same as the weight of an official baseball, namely not less than five nor more than five and one-quarter ounces avoirdupois. In order to provide the same feeling or liveliness in the batting practice baseball as is in an official baseball, the resilience of the batting practice baseball should be the same as or equivalent to the resilience of the official baseball. This is achieved by constructing the batting practice baseball with materials and with cotton and wool yarn tension sufficient to provide a coefficient of restitution of the batting practice baseball in the range of from approximately 51.4% to approximately 57.8%.

Use of the smaller batting practice baseball during batting practice should further refine the batting skills of a player and make the task of hitting the larger official baseball in a game situation much easier.

BRIEF DESCRIPTION OF THE DRAWING

The above and other objects and advantages and novel features of the present invention will become apparent from the following detailed description of the preferred embodiment of the present invention illustrated in the accompanying drawing wherein.

DESCRIPTION OF THE PREFERRED EMBODIMENT

Figure 1:
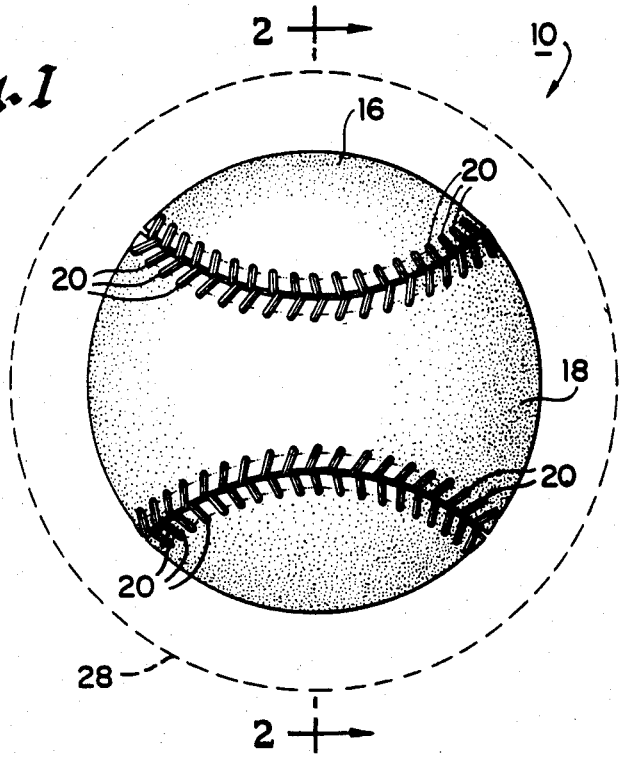
FIG. 1 is a top plan view of a batting practice baseball constructed in accordance with the principles of the present invention.

Referring to the drawing, there is illustrated a new and improved batting practice baseball 10 constructed in accordance with the principles of the present invention. The batting practice baseball 10 is spherical in shape and is formed by one or more windings 12 of cotton or wool yarn wound around a central weighted core 14 of cork, rubber or similar material and covered by two pieces 16 and 18 of leather, specifically white horsehide or cowhide, tightly stitched together by a plurality of cotton stitches 20. The central core 14 may be formed by a spherical weighted cork core 22 surrounded by a first layer 24 and a second layer 26 of rubber vulcanized on the cork core 22.

Figure 2:
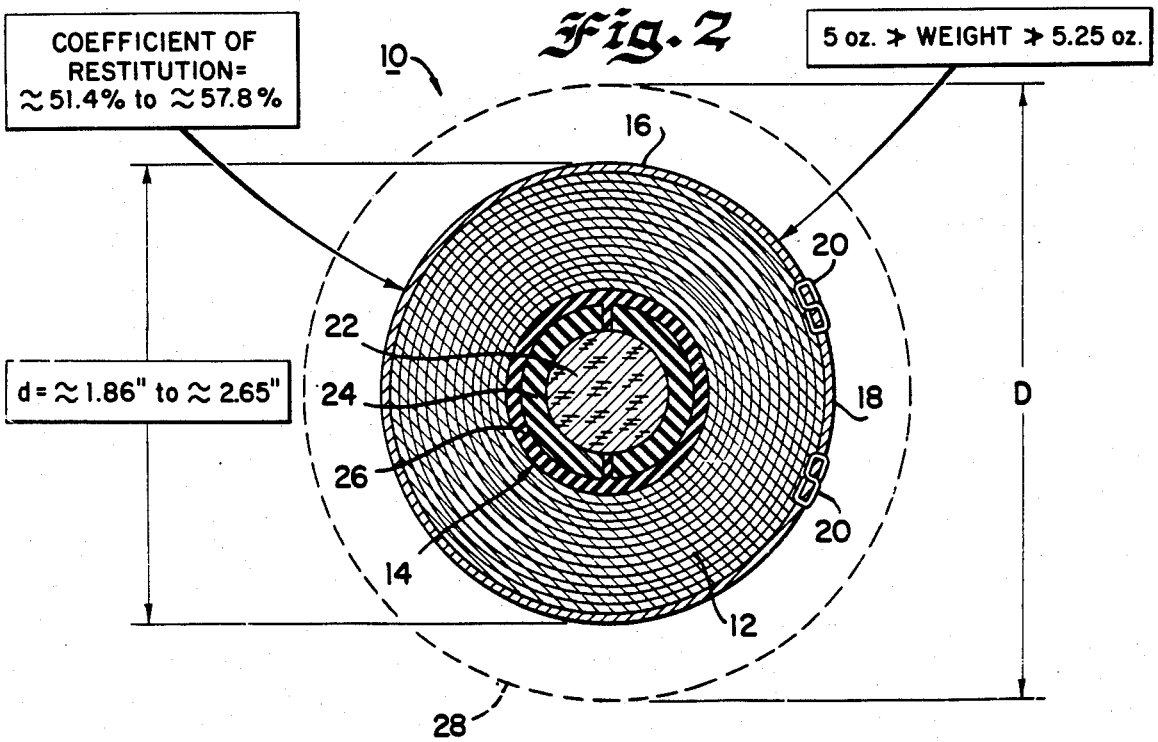
FIG. 2 is a cross sectional view of the batting practice baseball of FIG. 1 taken along line 2—2 of FIG. 1.

In accordance with an important feature of the present invention, the batting practice baseball 10 is dimensionally smaller than a regular or official baseball 28 illustrated in dotted line form in FIGS. 1 and 2 of the drawing and constructed in accordance with Rule 1.09 of the Official Baseball Rules. Specifically, the circumference of the official baseball 28 is not less than nine nor more than nine and one-quarter inches, resulting in an outer diameter "D" of not less than 2.87 nor more than 2.95 inches. In addition, the weight of the official baseball 28 is not less than five nor more than five and one-quarter ounces avoirdupois. The circumference of the batting practice baseball 10 is from approximately 65% to approximately 90% of the circumference of the official baseball 28. More specifically, the circumference of the batting practice baseball 10 is in the range of from approximately 5.85 to approximately 8.33 inches; and the outer diameter "d" of the batting practice baseball 10 is in the range of from approximately 1.86 to approximately 2.65 inches. In accordance with the preferred embodiment of the present invention, the circumference and outer diameter of the batting practice baseball 10 are approximately 77% of the circumference and diameter of the regular baseball 28, that is, seven inches and 2.23 inches, respectively. Preferably, the weight of the batting practice baseball is not less than five nor more than five and one-quarter ounces avoirdupois; and, in order to achieve the same resilience, feel or liveliness as the official baseball 28, the coefficient or restitution of the batting practice baseball 10 is in the range of from approximately 51.4% to approximately 57.8%. The weight of the batting practice baseball 10 recited above may be achieved by sufficiently weighting the central core 14 including, if necessary, using a relatively rigid material heavier than standard unweighted cork for the core 22. In order to achieve the resilience referred to above, the tension on the windings 12, particularly those formed of wool yarn, may be adjusted by increasing or decreasing the tension as required to achieve a coefficient of restitution in the range recited above.

Figure 3:
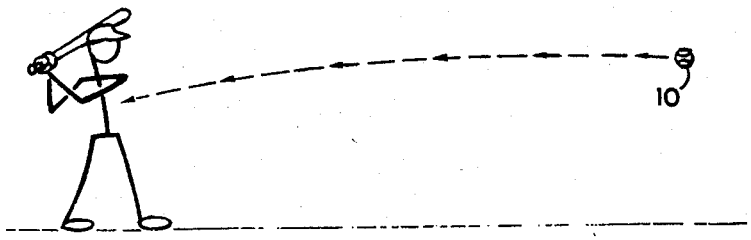
FIG. 3 is a pictorial representation of a batter and a baseball in accordance with the present invention.

In this manner, a new and improved batting practice baseball 10 is provided that is dimensionally smaller than the official baseball 28 but has the same feel to a player as the official baseball 28 when hit by a player during batting practice. A new and improved method of conducting batting practice in accordance with the principles of the present invention includes utilizing the dimensionally smaller batting practice baseball 10 during batting practice in order to further sharpen or refine the batting skills of a player. The batting practice baseball 10 illustrated in FIG. 3 would be pitched by a batting practice pitcher or by a pitching machine from the pitching mound to a batter separated from the mound by the prescribed distance in order to sharpen the hand-to-eye coordination and timing of the batter. In this manner, the task of hitting the dimensionally larger official baseball 28 during league games should be much easier for the batter who has participated in batting practice utilizing the dimensionally smaller batting practice baseball 10.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent of the United States is:

1. A batting practice baseball for use in batting practice comprising an interior portion and outer cover means for covering said interior portion, said outer cover means having an outer surface for engagement by a baseball bat, said interior portion and said outer cover means forming a completely spherical batting practice baseball having an outer diameter measured at said outer surface in the range of from 1.86 inches to 2.65 inches and having a total weight in the range of from five ounces to five and one-quarter ounces avoirdupois.

2. A batting practice baseball as recited in claim 1 wherein said outer diameter is 2.23 inches.

3. A batting practice baseball as recited in claim 1 wherein said completely spherical batting practice baseball has a coefficient of restitution in the range of from 51.4 percent to 57.8 percent.

4. A batting practice baseball comprising a central core, a winding of yarn surrounding said central core, two pieces of leather disposed about said winding and said central core and a plurality of stitches for tightly stitching together said two pieces of leather to form the outer surface of said batting practice baseball, the outer diameter of said batting practice baseball measured at said outer surface being in the range of from 1.86 inches to 2.65 inches and the weight of said batting practice baseball being in the range of from five to five and one-quarter ounces avoirdupois.

5. A batting practice baseball as recited in claim 4 wherein said batting practice baseball has a coefficient of restitution in the range of from 51.4 percent to 57.8 percent.

6. A batting practice baseball comprising a central core, a winding of yarn surrounding said central core, leather disposed about said winding and said central core to form the outer surface of said batting practice baseball, the outer diameter of said batting practice baseball being in the range of from 1.86 inches to 2.65 inches and the weight of said batting practice baseball being in the range of from five to five and one-quarter ounces avoirdupois.

7. A batting practice baseball is recited in claim 6 wherein said batting practice baseball has a coefficient of restitution in the range of from 51.4 percent to 57.8 percent.

8. A batting practice baseball comprising a central core and leather disposed about said central core to form the outer surface of said batting practice baseball, the outer circumference of said outer surface being in the range of from 5.85 inches to 8.33 inches and the weight of said batting practice baseball being in the range of from five to five and one-quarter ounces avoirdupois.

9. A batting practice baseball as recited in claim 23 wherein said batting practice baseball has a coefficient of restitution in the range of from 51.4 percent to 57.8 percent.

10. A baseball batting practice method comprising the steps of selecting a baseball having an outer surface with an outer circumference in the range of from 5.85 inches to 8.33 inches and a weight in the range of from five to five and one-quarter ounces avoirdupois and subsequently propelling said baseball from a distance to a target area in proximity to a human batter to enable said human batter to attempt to hit said baseball with a baseball bat and thereby improve said human batter's batting skills.

* * * * *

UNITED STATES PATENT AND TRADEMARK OFFICE

CERTIFICATE OF CORRECTION

PATENT NO. : 4,614,339

DATED : September 30, 1986

INVENTOR(S) : Stephen M. Schanwald

It is certified that error appears in the above-identified patent and that said Letters Patent are hereby corrected as shown below:

Column 4, line 38, "is" should be --as--.

Signed and Sealed this

Twenty-third Day of December, 1986

*Attest:*

DONALD J. QUIGG

*Attesting Officer* *Commissioner of Patents and Trademarks*